US008480547B2

(12) United States Patent
Coates

(10) Patent No.: US 8,480,547 B2
(45) Date of Patent: Jul. 9, 2013

(54) PORTABLE SLIDING EXERCISE DEVICE

(75) Inventor: Budd Coates, Emmaus, PA (US)

(73) Assignee: Rodale, Inc., Emmaus, PA (US)

( * ) Notice: Subject to any disclaimer, the term of this patent is extended or adjusted under 35 U.S.C. 154(b) by 365 days.

(21) Appl. No.: 12/886,838

(22) Filed: Sep. 21, 2010

(65) Prior Publication Data

US 2011/0071008 A1 Mar. 24, 2011

Related U.S. Application Data

(60) Provisional application No. 61/244,748, filed on Sep. 22, 2009.

(51) Int. Cl.
*A63B 21/00* (2006.01)
*A63B 71/00* (2006.01)

(52) U.S. Cl.
USPC ..... 482/92; 482/131; 482/141

(58) Field of Classification Search
USPC ..... 482/14, 19, 23, 44–50, 51, 62, 66, 482/75–76, 79, 91–96, 110, 114, 131–133, 482/139, 141, 146–148; D21/662, 684–686, D21/760
See application file for complete search history.

(56) References Cited

U.S. PATENT DOCUMENTS

| | | | | | |
|---|---|---|---|---|---|
| 4,358,106 | A * | 11/1982 | Shadford | 482/141 |
| 4,413,832 | A * | 11/1983 | Pendleton | 280/845 |
| 4,915,661 | A * | 4/1990 | Getgey | 446/48 |
| 6,338,703 | B1 | 1/2002 | Yu | |
| D503,755 | S * | 4/2005 | Schoening | D21/662 |
| 6,942,605 | B1 * | 9/2005 | Sukhovitsky | 482/132 |
| 7,559,878 | B2 * | 7/2009 | Hakooz | 482/51 |
| 7,563,211 | B1 * | 7/2009 | Wu | 482/123 |
| 7,585,262 | B1 * | 9/2009 | Vayntraub | 482/141 |
| 7,837,232 | B2 * | 11/2010 | Richards | 280/809 |
| 7,909,746 | B2 * | 3/2011 | Gant | 482/141 |
| 2006/0035771 | A1 * | 2/2006 | Gant | 482/141 |
| 2006/0116246 | A1 * | 6/2006 | Hankin | 482/51 |
| 2007/0287605 | A1 * | 12/2007 | Mylrea et al. | 482/92 |
| 2009/0298656 | A1 * | 12/2009 | Dannenberg | 482/141 |
| 2010/0317496 | A1 * | 12/2010 | Abranchess | 482/141 |

* cited by examiner

*Primary Examiner* — Oren Ginsberg
(74) *Attorney, Agent, or Firm* — Sughrue Mion, PLLC

(57) ABSTRACT

The exercise device includes a base plate and a handle disposed on the top surface of the base plate. The bottom surface of the base plate has a surface roughness Ra of less than 3 microinches, and preferably 1 to 2 microinches such that the device slides along a floor allowing the user to perform a plurality of exercises. The base plate includes a hole extending through a center thereof, whereby the base plate has a ring-like shape.

18 Claims, 20 Drawing Sheets

PORTABLE SLIDING EXERCISE DEVICE

RELATED APPLICATION

This application claims priority from U.S. Provisional Application No. 61/244,748 filed on Sep. 22, 2010, the contents of which are incorporated in their entirety.

BACKGROUND OF THE INVENTION

1. Field of the Invention

The present invention relates to exercise devices, and more particularly small, portable exercise devices 2. Description of Related Art Exercise devices capable of exercising multiple parts of the body are known. Examples include U.S. Pat. No. 7,575,385, U.S. Pat. No. 7,563,211, and U.S. Pat. No. 4,358,106. Typically these exercise devices include a plurality of weights and/or springs, movable or rotatable handgrips, and movable or foldable seats.

However, these exercise devices are generally complex machines having a plurality of parts that are disconnected and reassembled in another way for each respective exercise to be performed. Furthermore, typically these devices include many moving parts which require maintenance and repair over time.

Exercise devices that are small, light weight, and portable are also known. For example, U.S. Pat. No. 7,585,262 is directed toward convex push-up handle that assists a user in performing push-ups on the floor. U.S. Pat. No. 7,559,878 is directed toward an exercise device wherein the user places his or her hands or feet on contact points and moves them.

However, many of the small, portable exercise devices do not permit the user to perform a sufficient number of exercises to adequately exercise multiple parts of the body, or require multiple parts to move relative to one another.

Accordingly, there remains a continuing need for a simple, light weight exercise device that gives the user the ability to perform multiple exercises.

SUMMARY OF THE INVENTION

An aspect of an exemplary embodiment provides an exercise device including a base plate including a bottom surface on a top side, and a handle disposed on the top side of the base plate, wherein the bottom surface of the base plate has a surface roughness Ra of less than 3 microinches.

The surface roughness Ra of the bottom surface of the base plate may be approximately 1 to 2 microinches.

The base plate may include a hole extending through a center thereof, whereby the base plate has a ring-like shape. The handle may include a groove on each side thereof adapted to receive a thumb of a user. The handle may include a U-shaped hollow member. The exercise device may include a support member disposed within the hollow member.

The handle comprises a U-shaped member comprising a gripping portion and two leg portions extending downwardly from each end of the gripping portion; and wherein the gripping portions comprises a plurality of indentations disposed at a bottom side of the gripping portion. The support member may be disposed at a position between two adjacent ones of the indentations.

The handle may include a U-shaped member comprising a gripping portion and two leg portions extending from each end of the gripping portion; and a thickness of the handle at the ends of the gripping portion may be smaller than a thickness at a center of the gripping portion.

The exercise device may include fasteners that couple the handle to the base plate, wherein the fasteners do not extend through the bottom surface of the base plate. The bottom surface of the base plate may be nylon. A periphery edge of the base plate may include a chamfer.

An aspect of another exemplary embodiment provides a method of using a pair of exercise devices each including a base plate and a handle, including: holding the handle of each device with a hand; placing both devices against a floor; sliding the devices outwardly and away from one another; and sliding the devices inwardly and toward each other.

The sliding operations may be repeated. A chest of a user or a back of a user may face the floor during the sliding operations. The sliding outwardly of the devices may include sliding one of the devices outwardly to a further extent than the other of the devices. One of a chest and a back of a user may remain against the floor during the sliding operations.

The exercise device allows the user to perform a plurality of exercises to exercise multiple parts of the body without any moving parts and with a simple, light weight arrangement.

BRIEF DESCRIPTION OF THE FIGURES

The following drawings further describe by illustration the advantages and objectives of the present invention.

It is intended that any other advantages and objectives of the present invention that become apparent or obvious from the detailed description or illustrations contained herein are within the scope of the present invention.

DETAILED DESCRIPTION OF THE EXEMPLARY EMBODIMENTS OF THE INVENTION

Figure 1:
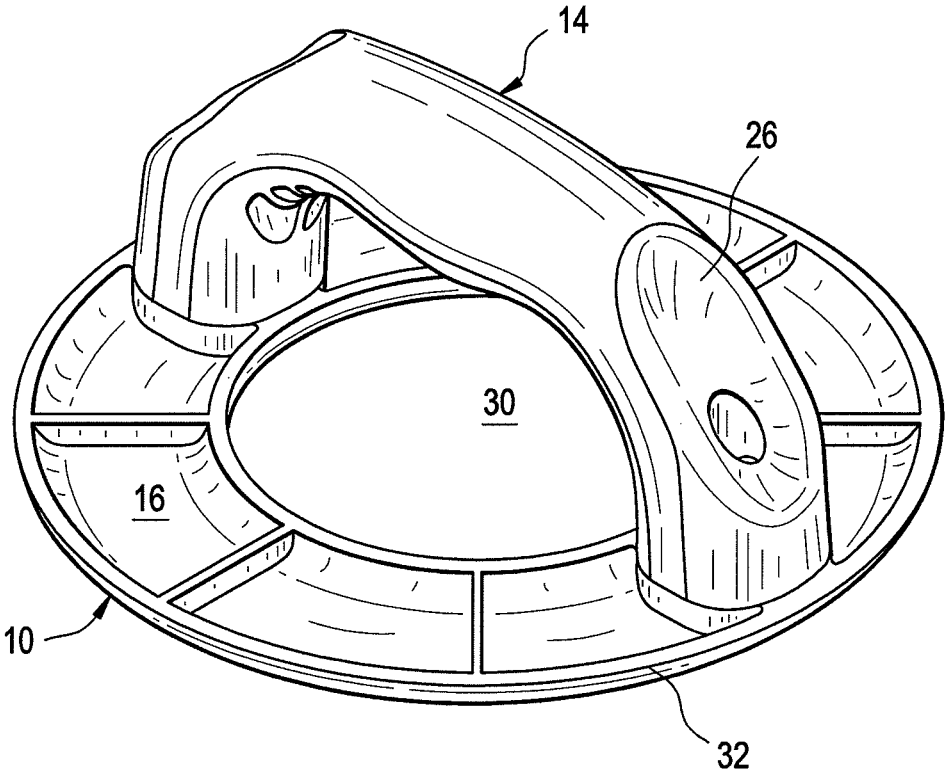
FIG. 1 is a perspective view of an exemplary embodiment of the present invention.
Figure 2:
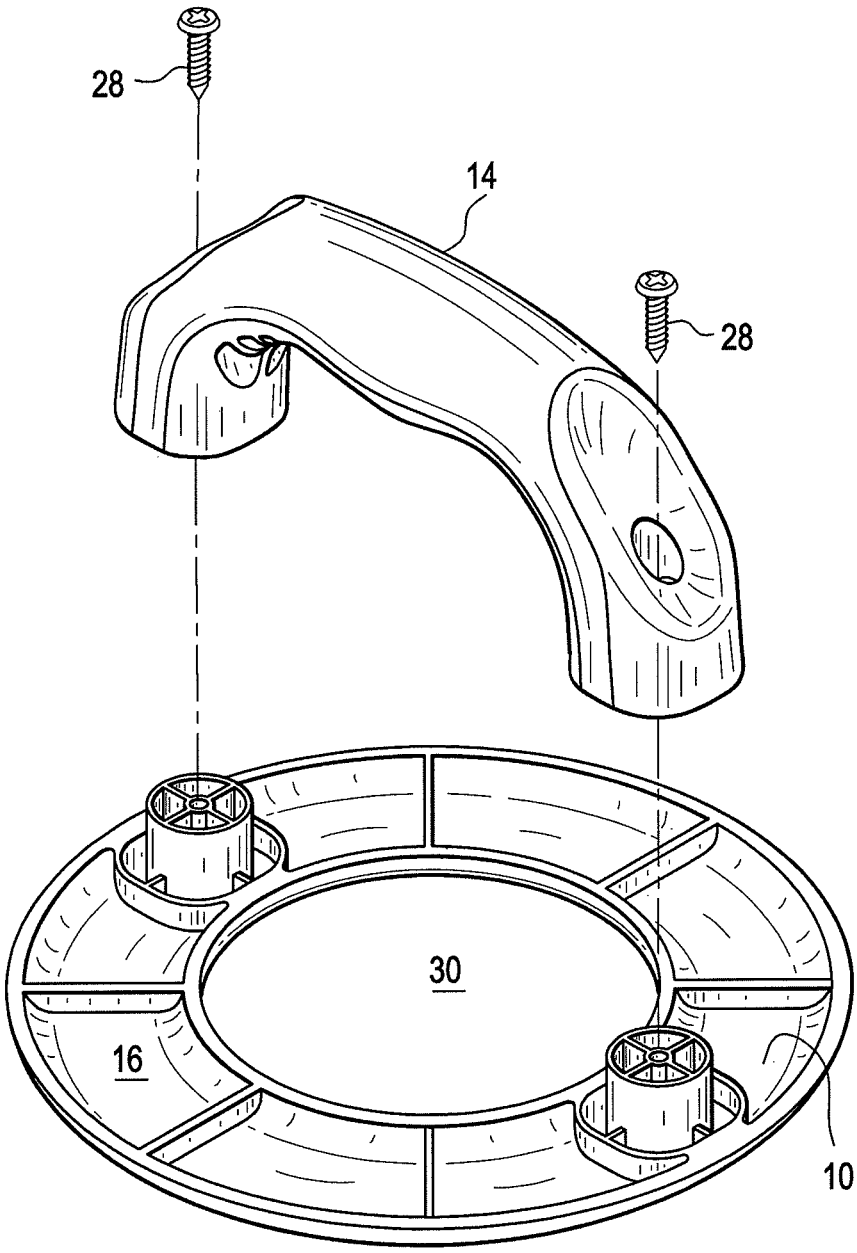
FIG. 2 is an exploded view of the embodiment of FIG. 1.

Throughout the detailed description like reference numerals correspond to like elements, and repetitive description of such elements is excluded. As shown in FIGS. 1 and 2, the exercise device includes a base plate 10 including a smooth bottom surface on a bottom side 12 thereof, and a handle 14 extending from the top side 16 of the base plate 10.

The handle 14 is an inverted U-shaped hollow member having a gripping portion 18 extending along a length direction and two side leg portions 20. The hollow gripping portion 18 may include a vertical center support member 22 extending through the inside thereof.

Figure 5:
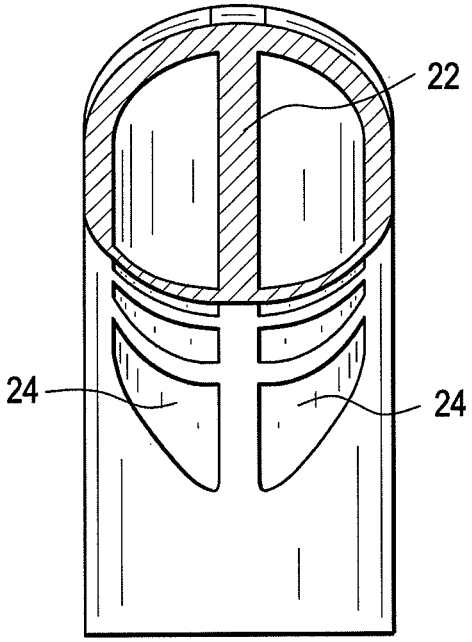
FIG. 5 is a cross-sectional view taken at line A-A of FIG. 2.
Figure 6:
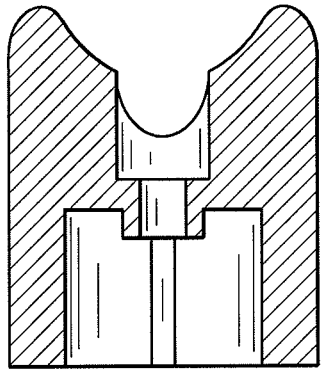
FIG. 6 is a cross-sectional view taken at line B-B of FIG. 2.
Figure 7:
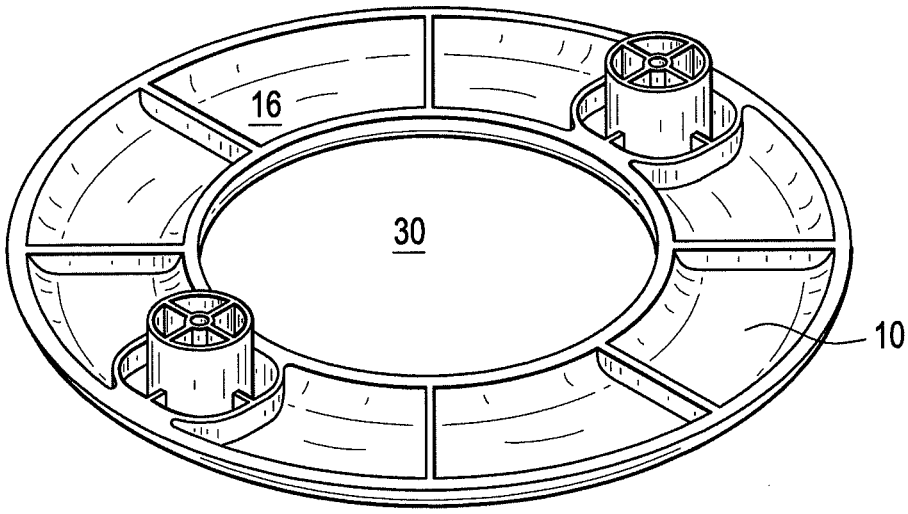
FIG. 7 is a perspective view of an exemplary embodiment of the base plate of the present invention illustrating the top surface thereof.
Figure 12:
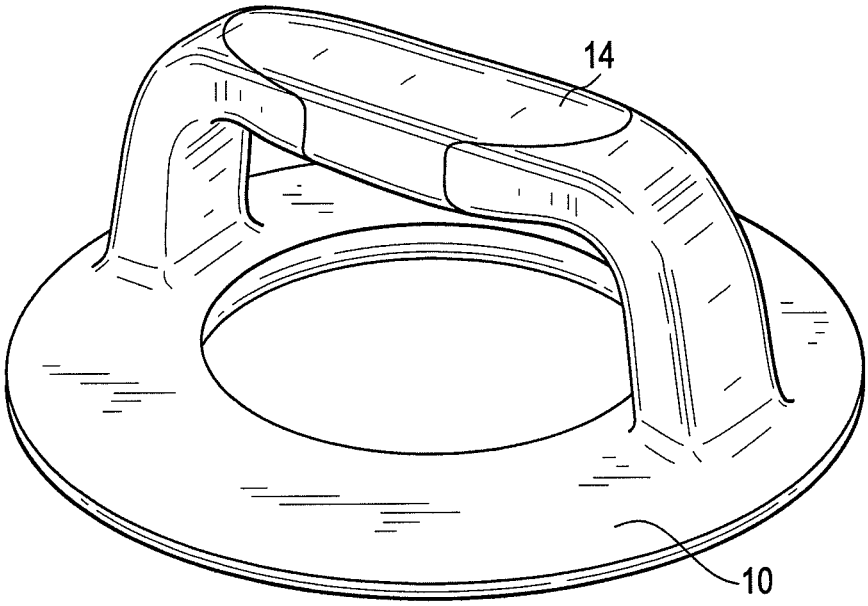
FIGS. 12-17 are alternative embodiments of the present invention.
Figure 13:
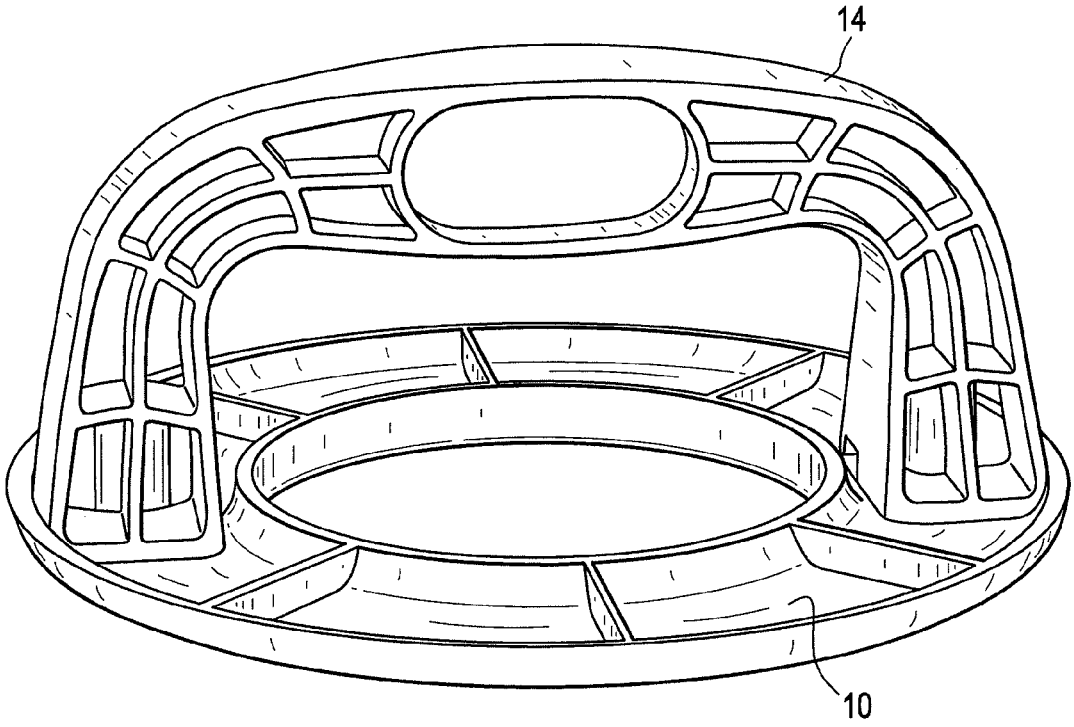
Figure 14:
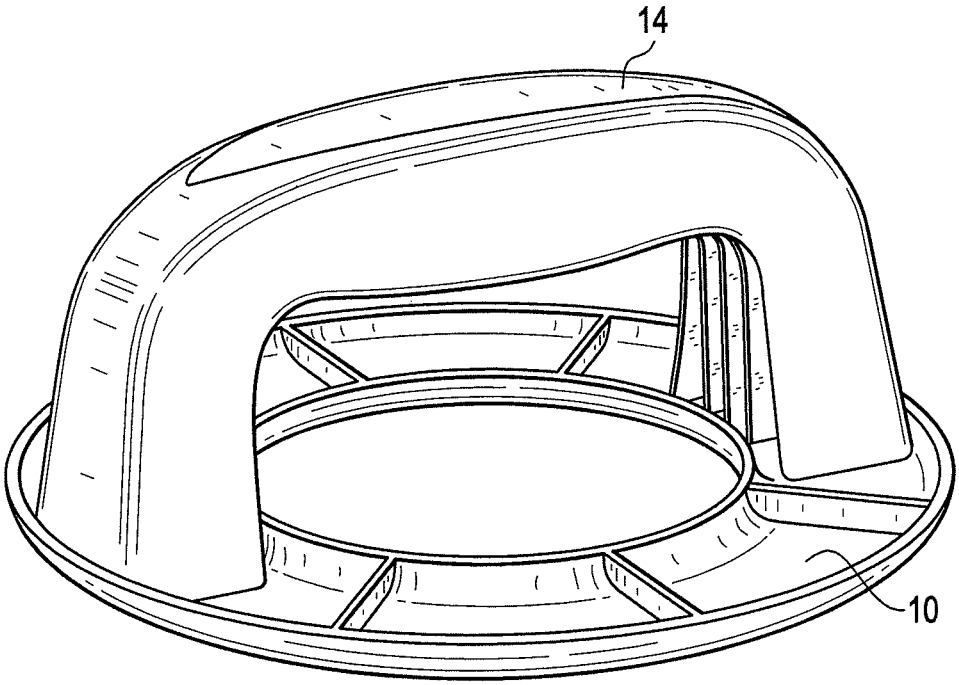
Figure 15:
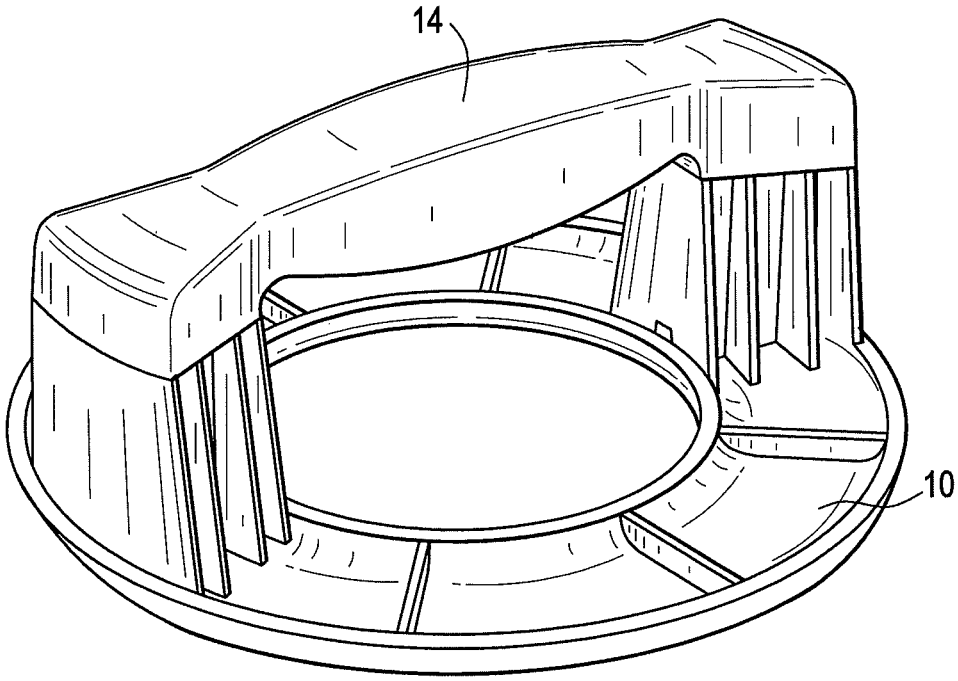

As shown in the embodiments of FIGS. 3-5 and 14, the gripping portion 18 includes a plurality of indentations 24 on an underside thereof. The plurality of indentations 24 may include two rows of indentations 24 with each row extending parallel to the length direction, wherein the center support 22 extends along the space between the two rows, as best shown in FIG. 5. In this embodiment, each indentation 24 is longer in a width direction of the handle than in the length direction. Alternatively, as shown in FIG. 14, the indentations 24 may each extend along the length direction wherein each indentation 24 is longer in the length direction of the handle 14 than in the width direction. Alternatively, there may be no indentations, as shown in FIGS. 12 and 13.

Figure 16:
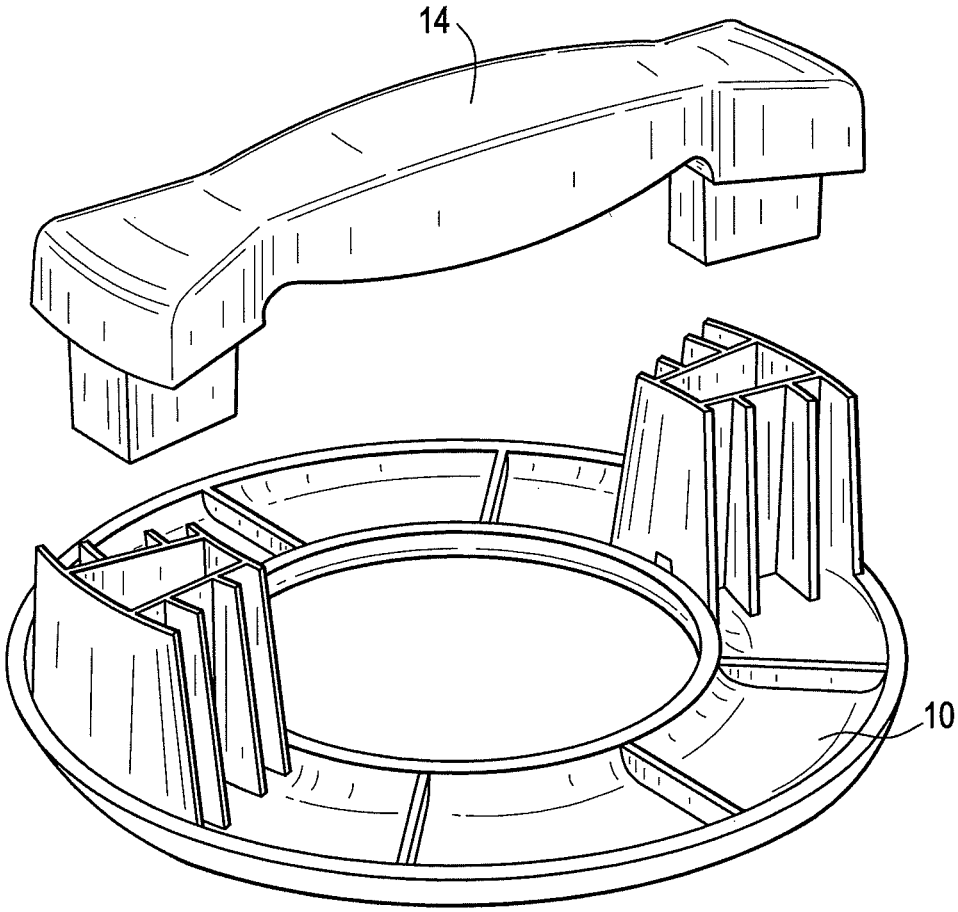

In the embodiments shown in FIGS. 3 and 13-15, a thickness of the handle 14 at locations where the gripping portion 18 meets each side leg portion 20 are smaller than the thickness of the center sections of the gripping portion 18 and of the side leg portions 20. The handle 14 may be made of thermoplastic, such as acrylonitrile butadiene styrene (ABS). The gripping portion 18 and two side leg portions 20 may be integrally formed as a single piece, for example see FIGS. 12-14, or may be formed separately and connected to one another, see FIGS. 2 and 16.

Figure 3:
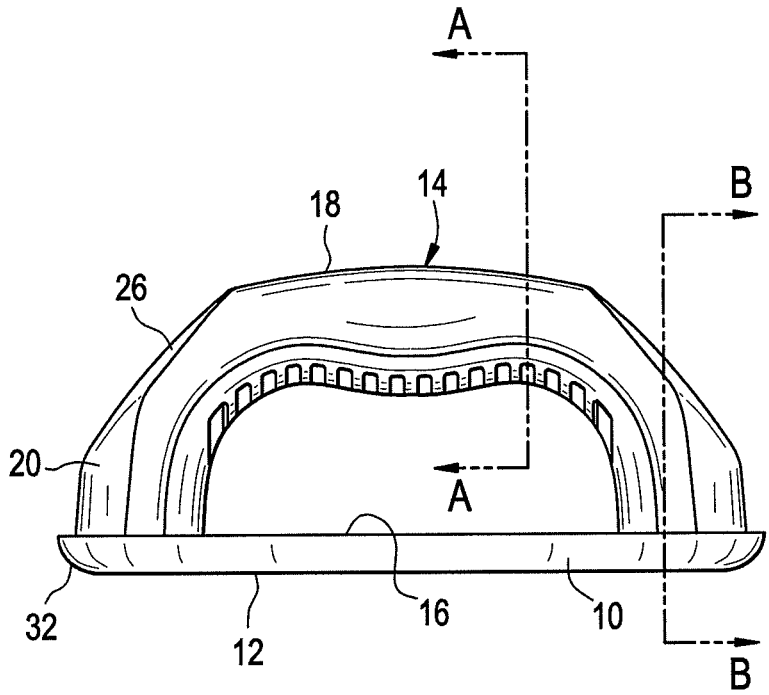
FIG. 3 is a front elevation view of the embodiment of FIG. 1.
Figure 4:
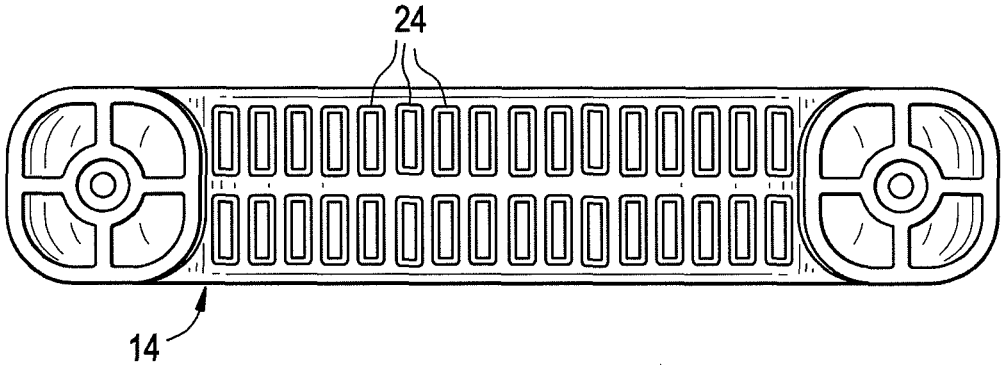
FIG. 4 is a bottom elevation view of the embodiment of the handle of FIG. 2.
Figure 17:
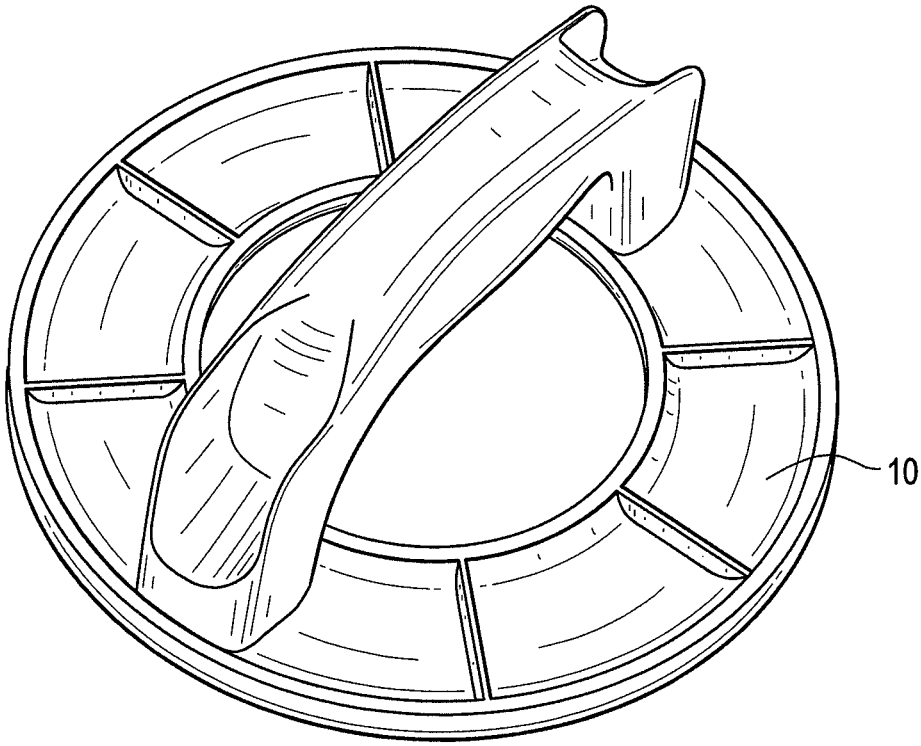

The handle 14 may include a thumb or finger groove 26 formed on each side of the gripping portion 18 or where the gripping portion 18 meets each side leg portion 20, as best shown in FIGS. 1-3 and 17. In the exemplary embodiments, the grooves 26 are each a concave surface. The grooves 26 allow the user to place a thumb therein for properly positioning the hand of the user during certain exercises. The shape and depth of the finger groove 26 may vary. For example, the finger groove 26 is preferably a shallow concave surface, as shown in FIG. 1-3, but may be a deep groove, as shown in FIG. 17.

The handle 14 is formed separately from the base plate 10 and attached to the base plate 10, for example, using fasteners 28 such as screws. As shown in FIGS. 2 and 3, the fasteners 28 may extend through each of the side leg portions 20 and into a raised portion on the top side 16 of the base plate 10, without extending through the bottom surface 12 of the base plate 10. This allows for the bottom surface 12 of the base plate 10 to be completely smooth. Alternatively, the fasteners 28 may extend through the base plate 10 up into the side leg portions 20 of the handle 14, as in the exemplary embodiment of FIG. 16.

The smooth bottom surface 12 of the base plate 10 has a surface roughness Ra of 3 microinches or less, and preferably a surface roughness Ra of 2 microinches or less, or even 1 microinch or less. A good range in practice is between approximately 1 and 2 microinches. The bottom surface 12 may be made of nylon with a surface finish of SPI-A2, according to the Society of the Plastics Industry standard. With a surface roughness of approximately 1 to 2 microinches the devices will slide on most floor surfaces, including but not limited to firm carpet, hard wood, smooth rubber, tile, and most linoleums.

Figure 8:
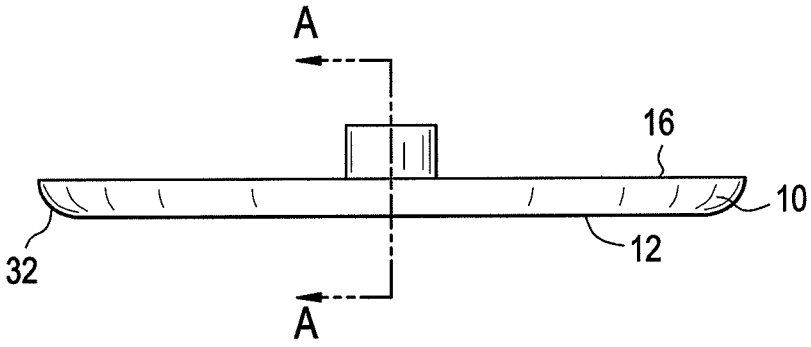
FIG. 8 is a side elevation view of the embodiment of FIG. 7.
Figure 9:
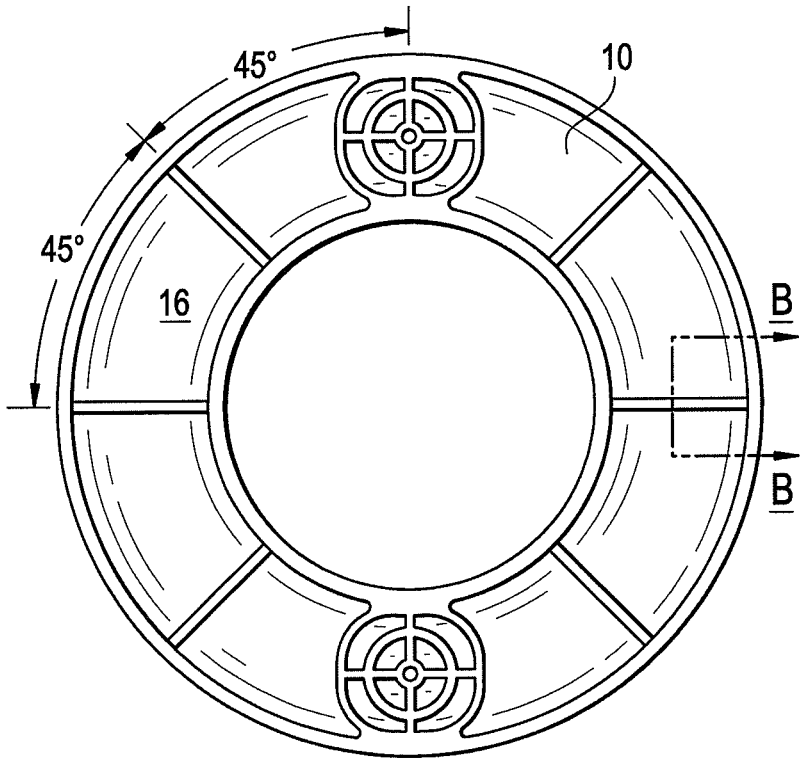
FIG. 9 is a top elevation view of the embodiment of FIG. 7.
Figure 10:
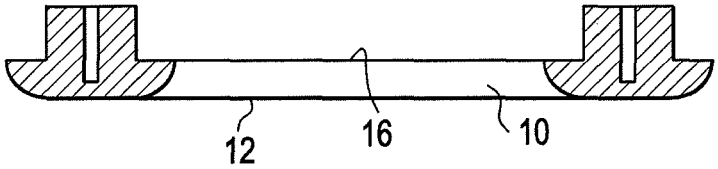
FIG. 10 is a cross-sectional view taken at line A-A of FIG. 8.
Figure 11:
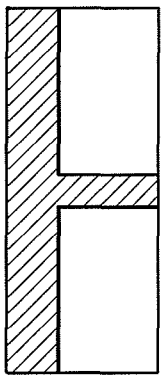
FIG. 11 is a cross-sectional view taken at line B-B of FIG. 9.

The base plate 10 is preferably disc-shaped, for example with a diameter of approximately 7 inches. As shown in the exemplary embodiments of the figures, the base plate 10 may include a hole 30 through a center thereof to form a ring-like shape. For example, the hole 30 may be approximately 3.75 inches. As best shown in FIGS. 3 and 8, the edges 32 of the base plate 10 may be radiused or chamfered. For example, the edges 32 of the bottom surface 12 of the base plate 10 may have a radius of curvature of approximately 0.38 inches.

The exercise device of the present invention slides along a number of different floor surfaces in response to the user performing an exercise. Consequently, the user is able to perform a plurality of different exercises to exercise many parts of the body using a single device and without having to reconfigure the device. Furthermore, there are no moving parts such that maintenance of the device is low. In addition, the device is compact and light weight. Because the exercise device works on almost any surface and is light weight and compact, the user can use the exercise device while away from home, for example while traveling. The device can also be used for exercises such as push-ups, plank exercises, and stretches.

Exemplary Embodiments of Exercises Using the Exercise Device of the Present Invention FIGS. 18-24 illustrate methods of using the exercise device of the present invention.

Figure 25:
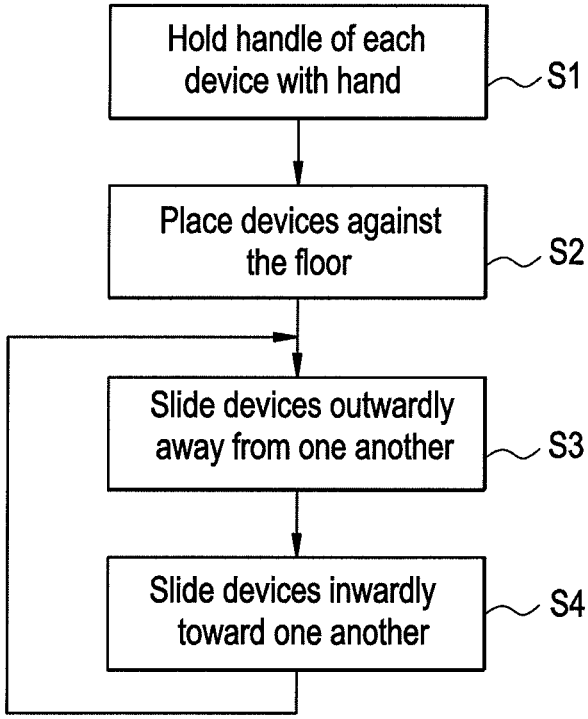
FIG. 25 is a flow chart of an exemplary embodiment of the method of using the present invention.

An exemplary embodiment of the method of using a pair of exercise devices includes holding the handle of each device with a hand; placing the bottom surface of the base plates of both devices against a floor; sliding the devices outwardly and away from one another; and sliding the devices inwardly and toward each other, as shown in FIG. 25.

Figure 18:
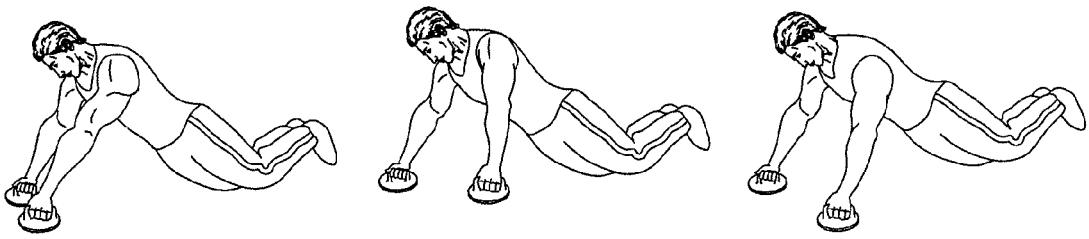
FIGS. 18-24 are schematic illustrations illustrating a user using the present invention according to exemplary embodiments of the present method.
Figure 22:
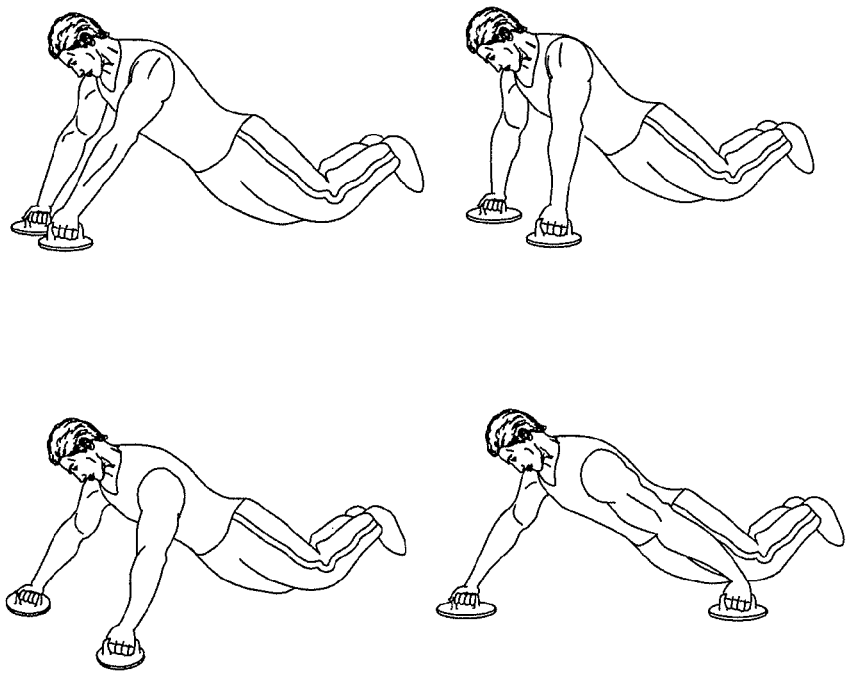

In the exemplary embodiment shown in FIG. 18, the user holds an exercise device in each hand with the palms of the hands facing downwardly toward the floor, and begins the exercise in a modified push-up position with the bottom surface 12 of each base plate 10 against the floor. The user then slides one of the two devices forward while holding the other stable, as shown in the center of FIG. 18, or alternatively slides both devices forward. Thereafter, the user retracts the device or devices back to the original position. FIG. 22 illustrates a similar exercise.

Figure 19:
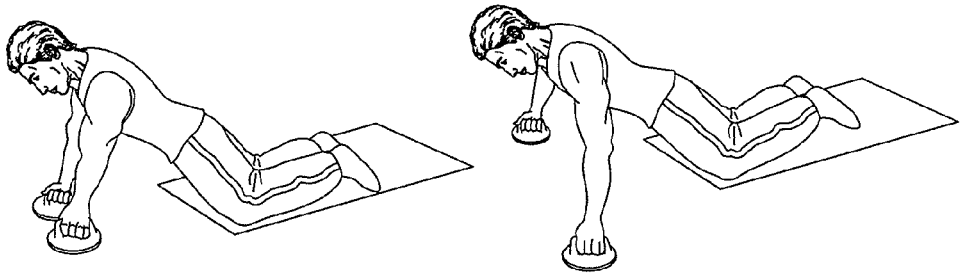

In the exemplary embodiment shown in FIG. 19, the user holds an exercise device in each hand with the palms of the hands facing downwardly toward the floor, and begins the exercise in a modified push-up position with the bottom surface 12 of each base plate 10 against the floor. The user simultaneously slides both devices outwardly to the sides and then slides both devices back inwardly to the original position.

Figure 20:
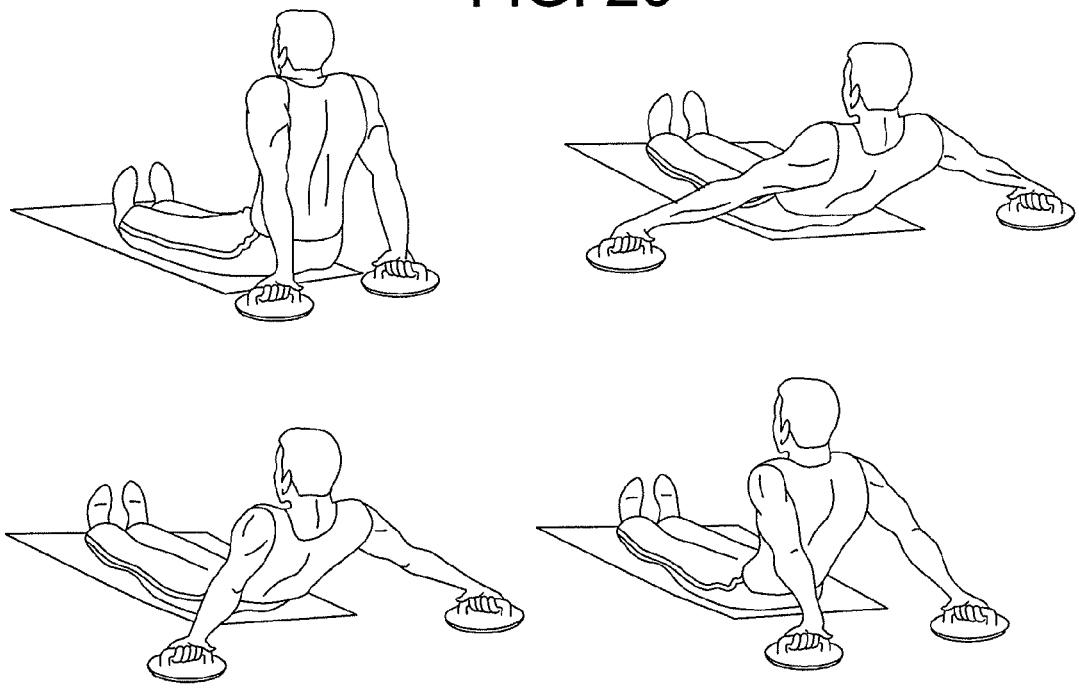

In the exemplary embodiment shown in FIG. 20, the user sits on the floor with the legs of the users extended outwardly, and holding a device in each hand, with the palms of the hands facing downwardly toward the floor. The user then simultaneously slides both devices outwardly to the sides while moving the user's upper body in a backwardly direction. The user then pulls the devices back into the original position.

Figure 21:
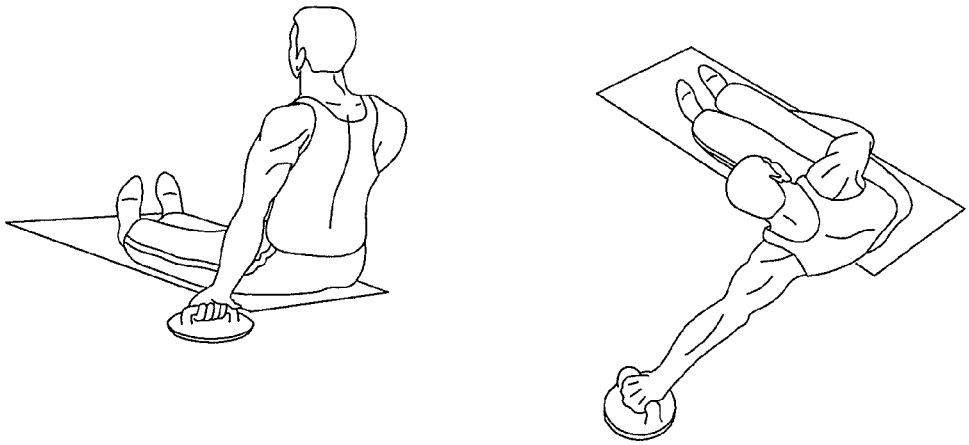

In the exemplary embodiment shown in FIG. 21, the user sits on the floor with the legs of the user extended outwardly, and holding a device in one hand, with the palm of the hand facing downwardly toward the floor. The user slides the one device out to the side while moving the upper body to that same side. The user then pulls the device back into the original position.

Figure 23:
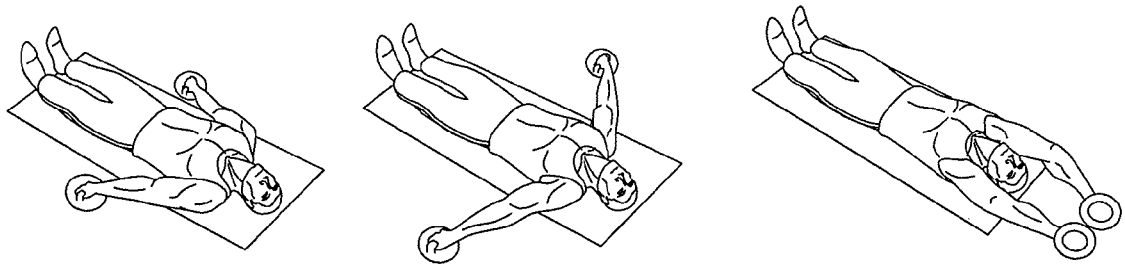

In the exemplary embodiment shown in FIG. 23, the user begins laying face-up, flat on the floor holding a device in each hand, with the palms of the hands facing upwardly and the arms of the user positioned at the sides of the body adjacent the hips. The user then slides the devices along the floor upwardly without substantially bending the elbow until the devices are positioned adjacent one another above the user's head. Alternatively, the user may face the floor, i.e., lay on the user's stomach.

Figure 24:
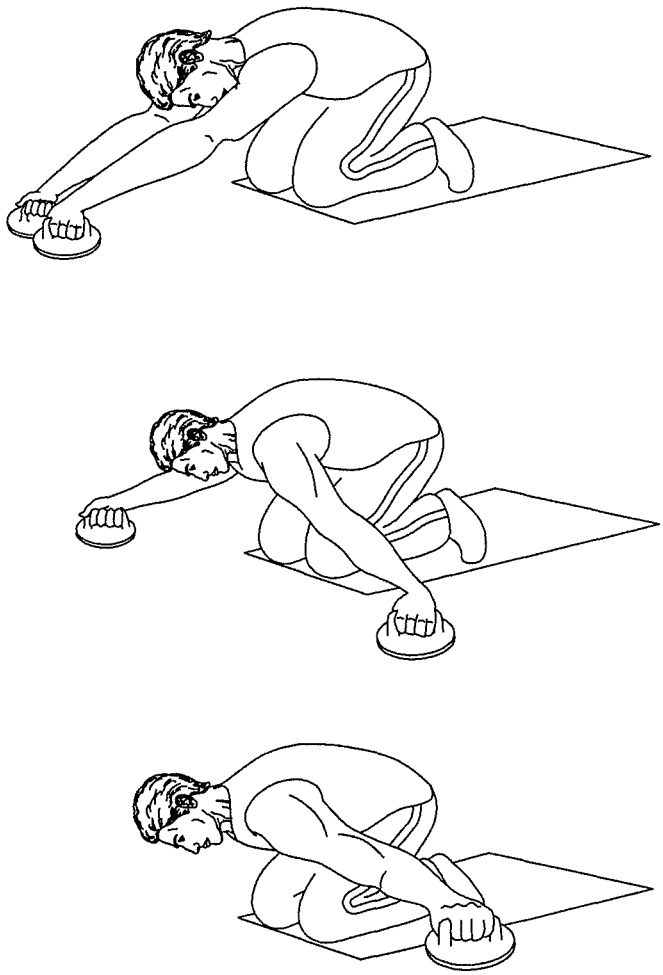

In the exemplary embodiment shown in FIG. 24, the user begins sitting on the user's knees holding a device in each hand against the floor, with the palms of the hands facing downwardly and the arms of the user stretched outwardly in front of the user. The user simultaneously slides the devices outwardly to the sides in a circular pattern and continues until the devices are adjacent the user's feet. The user then slides the devices back into their original position.

Alternatively, the user may begin sitting on the user's knees holding a device in each hand against the floor, with the palms of the hands facing downwardly toward the floor and the arms of the user stretched outwardly in front of the user. In the beginning position, the user is resting back on his feet. The user then pulls the user's body away from his feet while sliding the devices farther out in front of the user. The user then returns to the original position.

While the foregoing has described the general physical aspects of the invention and is to serve as an aide to better understanding the intended use and application of the invention, one skilled in the art would understand that the present invention is not limited to the detailed construction, fabrication, material or application of use described and illustrated herein. Other variations of fabrication, use or application are within the scope of the invention as alternative embodiments.

What is claimed is:

1. An exercise device comprising:

a base plate having a bottom surface and a top surface; and a handle disposed on the top surface of the base plate;

wherein the bottom surface of the base plate has a surface roughness Ra of less than 3 microinches, wherein the base plate includes a hole extending through center thereof, whereby the base plate has a ring-like shape, and wherein the handle comprises a U-shaped hollow member.

2. The exercise device according to claim 1, wherein the surface roughness Ra of the bottom surface of the base plate is approximately 1 to 2 microinches.

3. The exercise device according to claim 1, wherein the handle includes a groove on each side thereof adapted to receive a thumb of a user.

4. The exercise device according to claim 1, further comprising a support member disposed within the hollow member.

5. The exercise device according to claim 4, wherein the handle comprises a U-shaped member comprising a gripping portion and two leg portions extending downwardly from each end of the gripping portion; and wherein the gripping portion comprises a plurality of indentations disposed at a bottom side of the gripping portion.

6. The exercise device according to claim 5, wherein the support member is disposed at a position between two adjacent ones of the indentations.

7. The exercise device according to claim 1, wherein the handle comprises a gripping portion and two leg portions extending from each end of the gripping portion; and wherein a thickness of the handle at the ends of the gripping portion is smaller than a thickness at a center of the gripping portion.

8. The exercise device according to claim 1, further comprising fasteners that couple the handle to the base plate, wherein the fasteners do not extend through the bottom surface of the base plate.

9. The exercise device according to claim 1, wherein the bottom surface of the base plate is nylon.

10. The exercise device according to claim 1, wherein a periphery edge of the base plate comprises a chamfer.

11. The exercise device according to claim 1, wherein the surface roughness Ra of the bottom surface of the base plate is less than 1 microinch.

12. The exercise device according to claim 6, wherein the plurality of indentations extend parallel to a length direction of the handle, and each indentation is longer in a width direction of the handle than the length direction.

13. A method of using a pair of exercise devices each including a base plate and a handle, the method comprising:

holding the handle of each device with a hand;

placing both devices against a floor;

sliding the devices outwardly and away from one another; and sliding the devices inwardly and toward each other, wherein the base plate includes a hole extending through a center thereof, whereby the base plate has a ring-like shape, and wherein the handle comprises a U-shaped hollow member.

14. The method according to claim 13, further comprising repeating the sliding operations.

15. The method according to claim 13, further comprising facing a chest of the user toward the floor during the sliding operations.

16. The method according to claim 13, further comprising facing a back of the user toward the floor during the sliding operations.

17. The method according to claim 13, wherein the sliding the devices outwardly comprising sliding one of the devices outwardly to a further extent than the other of the devices.

18. The method according to claim 13, wherein one of a chest and a back of a user remains against the floor during the sliding operations.

* * * * *